US005820939A

United States Patent [19]

Popoola et al.

[11] Patent Number: 5,820,939

[45] Date of Patent: Oct. 13, 1998

[54] METHOD OF THERMALLY SPRAYING METALLIC COATINGS USING FLUX CORED WIRE

[75] Inventors: Oludele Olusegun Popoola, Grand Blanc; Matthew John Zaluzec, Canton; Armando Mateo Joaquin, Rochester Hills; Deborah Rose Pank, Saline; David James Cook, Farmington Hill, all of Mich.

[73] Assignee: Ford Global Technologies, Inc., Dearborn, Mich.

[21] Appl. No.: 829,666

[22] Filed: Mar. 31, 1997

[51] Int. Cl.[6] ..... C23C 4/16; C23C 4/06

[52] U.S. Cl. ..... 427/449; 427/456; 219/76.14; 219/145.22; 219/146.23; 219/146.24; 219/146.3; 219/146.41

[58] Field of Search ..... 219/145.22, 146.23, 219/146.24, 146.3, 146.41, 76.14, 76.16; 427/449, 456

[56] References Cited

U.S. PATENT DOCUMENTS

| | | | |
|---|---|---|---|
| 3,546,415 | 12/1970 | Marantz | 219/76 |
| 3,935,421 | 1/1976 | Ballass et al. | 219/146 |
| 4,762,977 | 8/1988 | Browning | 219/121.47 |
| 5,194,304 | 3/1993 | McCune, Jr. et al. | 427/449 |
| 5,296,667 | 3/1994 | Marantz et al. | 219/121.47 |
| 5,308,698 | 5/1994 | Bishel et al. | 428/385 |
| 5,442,153 | 8/1995 | Marantz et al. | 219/121.47 |
| 5,468,295 | 11/1995 | Marantz et al. | 118/300 |
| 5,514,422 | 5/1996 | McCune | 427/449 |
| 5,723,187 | 3/1998 | Popoola et al. | 427/453 |

FOREIGN PATENT DOCUMENTS 845410 7/1956 United Kingdom .

*Primary Examiner*—Katherine A. Bareford
*Attorney, Agent, or Firm*—Joseph W. Malleck

[57] ABSTRACT

A method of thermally spraying at least one adherent metallic coating onto an unroughened cleansed aluminum or aluminum alloy substrate to produce a coated substrate, comprising: wire-arc thermally spraying of melted metallic bonding droplets and fluxing particles onto the substrate using air propulsion to concurrently adherently deposit flux particles and bonding droplets, the spraying using air propulsion and a wire feedstock having a core and a sheath, the wire core being constituted of both metal powder readily metallurgically bondable to the substrate and a fluxing powder that readily deoxidizes the substrate, the wire sheath being constituted of pliable metal that is metallurgically compatible with the core metal powder, the fluxing powder having a halide salt chemistry effective to deoxidize the substrate upon contact of the melted fluxing powder therewith, said fluxing powder and bonding metal having a particle size that more uniformly promotes distribution throughout said spray. A flux cored wire for use in thermal spraying of aluminum or aluminum alloy substrates, comprising (a) a powder core mixture consisting of (i) a metal bonding powder effective to metallurgically bond by an exothermic reaction with the substrate when the bonding metal powder is in a melted condition, (ii) a fluxing powder effective to strip aluminum oxides from said substrates when in the melted condition, (b) a pliable metal sheath encapsulating the powder mixture and having a composition that is metallurgically compatible with the bonding metal and also is effective to react with aluminum surfaces to form intermetallics.

11 Claims, 3 Drawing Sheets

METHOD OF THERMALLY SPRAYING METALLIC COATINGS USING FLUX CORED WIRE

BACKGROUND OF THE INVENTION

1. Technical Field

This invention relates to thermally spraying hard surface coatings onto aluminum alloy automotive components and, more particularly, to the use of cored wires that carry flux to promote adhesion of thermally sprayed metal on aluminum or aluminum alloys.

2. Discussion of the Prior Art

Aluminum alloys are currently being used in automotive components such as engine blocks and heads, pistons, bucket tappets, brake rotors, and others to reduce weight and meet federal fuel economy standards. In most of such applications, there is a need to coat surfaces of such components to withstand thermal-mechanical stresses imposed upon them during use. Heretofore, thermal spraying techniques have been used to apply temperature resistant coatings to aluminum surfaces but have often required some kind of roughening as a surface preparation prior to coating to ensure adhesion. Such roughening has usually included some form of grit blasting, high pressure water jetting, electric discharge machining, etc. It would be desirable if the need for such roughening step could be eliminated without sacrificing adhesion.

When welding steels, cast iron and some non-ferrous alloys, surface preparation of the part to be welded has been eliminated by use of flux cored welding wires. Such flux cored weld wires need $CO_2$ gas shielding to operate properly and create a fusible slag that floats to the top of a molten weld puddle so as not to interfere with fusion. The use of such flux cored weld wires have increased tolerance for scale and dirty weld conditions, but usually are limited to the fusion of butt, corner and T joints.

Even more recently flux cored brazing rings have been used as implants to braze aluminum alloy sheet metal. These rings require a bond metal composition (Al-Si) that is not adaptable to thermal spraying because it melts at too low a temperature which is satisfactory for slow brazing, but not for instantaneous thermal spraying. Wire feedstock for thermal spraying has heretofore included lubricant or wear resistant particles, but not a powder flux. Certain problems must be overcome if flux is to be deployed successfully as a cored material in a wire feedstock for thermal spraying, such as providing (a) for instantaneous surface stripping of surface oxides within the dynamics of thermal spray contact time, (b) particle size control for both the flux and bond metal powders to allow for instantaneous uniform reactions from contact, and (c) an effective ratio of costituents of the wire feedstock to promote instantaneous fluxing.

SUMMARY OF THE INVENTION

The invention in a first aspect is a method of thermally spraying at least one adherent metallic coating onto an unroughened cleansed aluminum or aluminum alloy substrate to produce a coated substrate, comprising: wire-arc thermally spraying of melted metallic bonding droplets and fluxing particles onto the substrate using air propulsion to concurrently adherently deposit flux particles and bonding droplets, the spraying using air propulsion and a wire feedstock having a core and a sheath, the wire core being constituted of both metal powder readily metallurgically bondable to the substrate and a fluxing powder that readily deoxidizes the substrate, the wire sheath being constituted of pliable metal that is metallurgically compatible with the core metal powder, the fluxing powder having a halide salt chemistry effective to deoxidize the substrate upon contact of the melted fluxing powder therewith, said fluxing powder having a particle size that more uniformly promotes distribution throughout said spray.

The invention in a second aspect is a flux cored wire for use in thermal spraying of aluminum or aluminum alloy substrates, comprising (a) a powder core mixture consisting of (i) a metal bonding powder effective to metallurgically bond by an exothermic reaction with the substrate when the bonding metal powder is in a melted condition, (ii) a fluxing powder effective to strip aluminum oxides from said substrates when in the melted condition, (b) a pliable metal sheath encapsulating the powder mixture and having a composition that is metallurgically compatible with the bonding metal and also is effective to react with aluminum surfaces to form intermetallics.

It is an advantage of this invention that it eliminates steps of stirring, drying and dehumidification of conventional wet applied fluxes, while promoting equal or increased adhesion through the dynamics of instantaneous fluxing and bonding.

DETAILED DESCRIPTION AND BEST MODE

Figure 1:
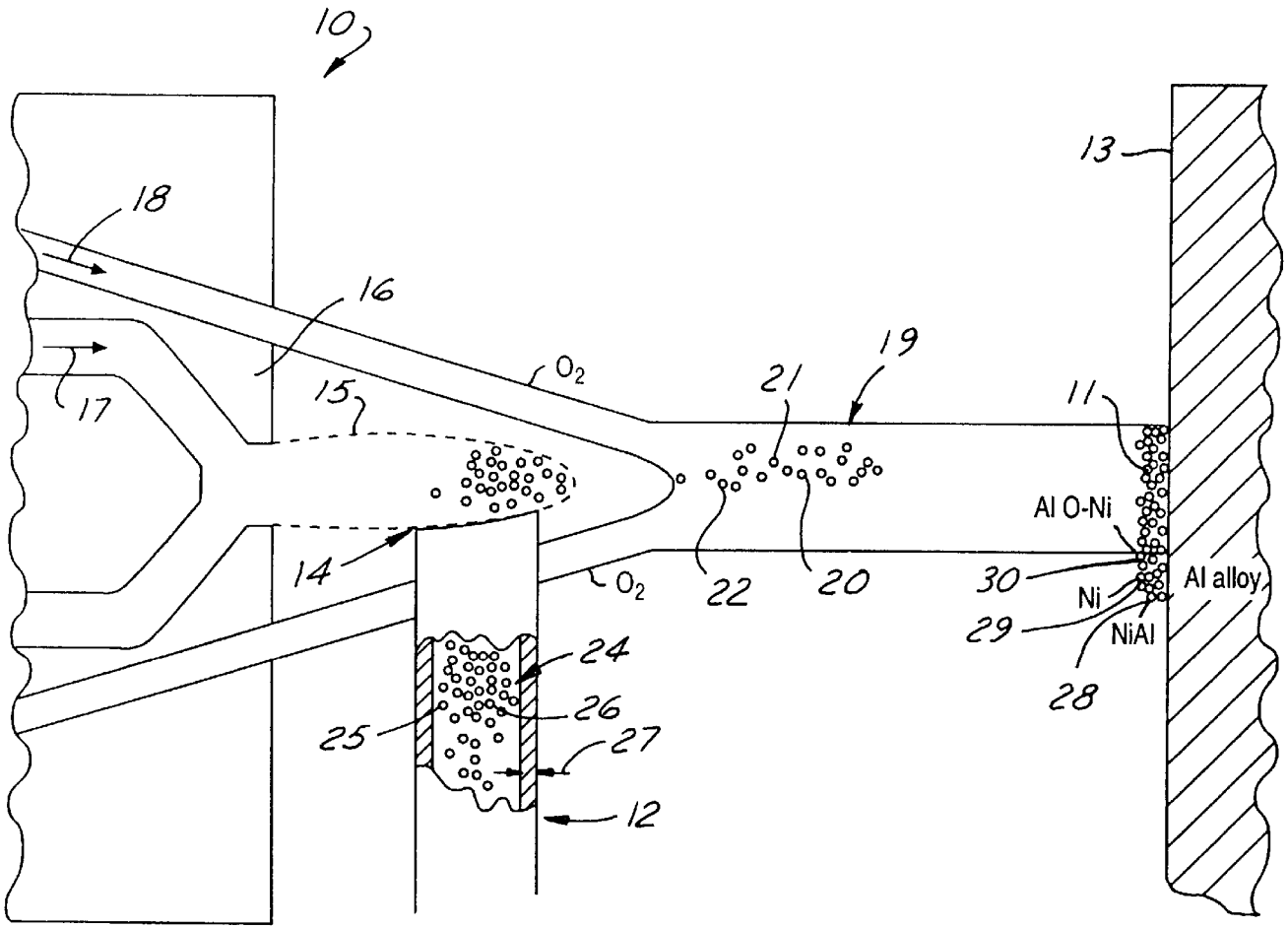
FIG. 1 is an enlarged schematic illustration of the thermal spray pattern created by this invention and the deposited coating particles, showing portions of the nozzle of a wire arc thermal spray gun and the tip of the flux core wire used in the process.

As shown in FIG. 1, the method of this invention briefly involves thermally spraying, such as by use of a gun 10, at least one adherent metallic coating 11 by use of a wire feedstock 12, onto an unroughened cleansed substrate 13 of aluminum or titanium alloy. The wire is melted by subjecting its tip 14 to a plasma 15 created by an arc either at the nozzle 16 or transferred to the wire tip 14. Plasma creating gas 17, as well as shrouding gas 18 form a spray pattern 19 that projects melted flux particles 20, melted bonding metal droplets 21 and melted droplets 22 of sheath metal of the wire, onto the substrate to form a thin coating 11. The melted flux particles instantaneously strip the substrate of substrate oxides upon impact therewith and the concurrently deposited bonding metal droplets immediately metallurgical bond with the oxide-stripped substrate.

The wire 12 is comprised of a pliable metal sheath 23 encapsulating (wrapped about) a powder core mixture 24 consisting of (i) a bonding metal powder 25 effective to metallurgical bond (preferably by an exothermic reaction) with the substrate when in the melted condition, a fluxing powder 26 effective to strip away oxides from the substrate when the fluxing powder is in the melted condition. The metal sheath 23 has a thickness 27 of about 0.01 inch and has a composition that is metallurgically compatible (forms intermetallics with aluminum or its alloys) with the bonding metal powder of the core and is preferably some form of nickel, copper or iron. The sheath metal in more particularity is constituted of a metal selected from the group of Fe-Al, bronze-Al, bronze-Si, and most advantageously, straight nickel. The metals of this group possess the following characteristics (which are needed to function as a pliable sheath and form part of the coating on the aluminum or aluminum alloy): they melt at temperatures above 660° C. and are reactive with aluminum.

The fluxing powder 26 is chemically constituted to deoxidize aluminum or titanium when heat activated and is a halide salt that is preferably selected from KAlF, KAlF+LiF or KAlF+LiF+CsF. KAlF means predominately $KAlF_4$ with minor amounts of $K_2AlF_5$ (about 15% by weight) and $K_3AlF_6$ (about 5%). Such fluxing powder is present in the core in an amount of 0.7–10% by weight of the wire, but preferably 0.7–3% to achieve certain bonding characteristics. The particle size range of the fluxing powder is generally 2–40 micrometers, but the optimum average particle size is about 2–10 micrometers.

The metal bonding powder 21 is preferably selected from the group Ni-Al (optimally 95 Ni/5Al), Fe-Al, bronze-Al, and Si-bronze. The overall particle size range of the metal bonding powder is 10–400 micrometers, and advantageously the mean particle size of the bonding powder is about 100 micrometers. The metal bonding powder particle size must be larger than the flux powder particle size when selected; this insures a more effective adjacency of the flux powder to more bond metal particles. The volume ratio of the fluxing powder 20 to the metal bonding powder 21 is about 3:7 and the respective weight ratio is about 1:10. The weight ratio of the powder core mixture 24 to the sheath metal 23 is about 1:3.

The spray pattern 19 impacts the substrate at a velocity of about 100–200 meters per second, with the droplets of the wire being at a temperature of about 1500°–1800° C. Upon impact of the substrate, the fine droplets of melted fluxing powder instantaneously chemically dissolve the oxides (i.e. $Al_2O_3$) on the substrate surface. The byproducts are volatilized and do not seem to enter into or be present in the coated product as evidenced by FIG. 3.

The first stage of thermal spraying of a coating is comprised of intermingled particles of Ni-Al (28), Ni (29), and some disbursed oxides (30)of Ni-Al or Ni. These oxides of Ni-Al or Ni appear as a result of the dynamics of using a flux cored wire; Ni and Ni-Al oxides are very useful because they enhance the adhesion of the coating to the substrate by presenting an oxygenated surface to a non-oxidized aluminum. The bonding metal particles 25 and fluxing powder 26 do not have to be homogeneously blended in the mixture in the core wire to function effectively; the turbulence created by the wire arc melting and gas propulsion will redistribute the droplets to increase their random distribution and thereby homogeneity.

Figure 2:
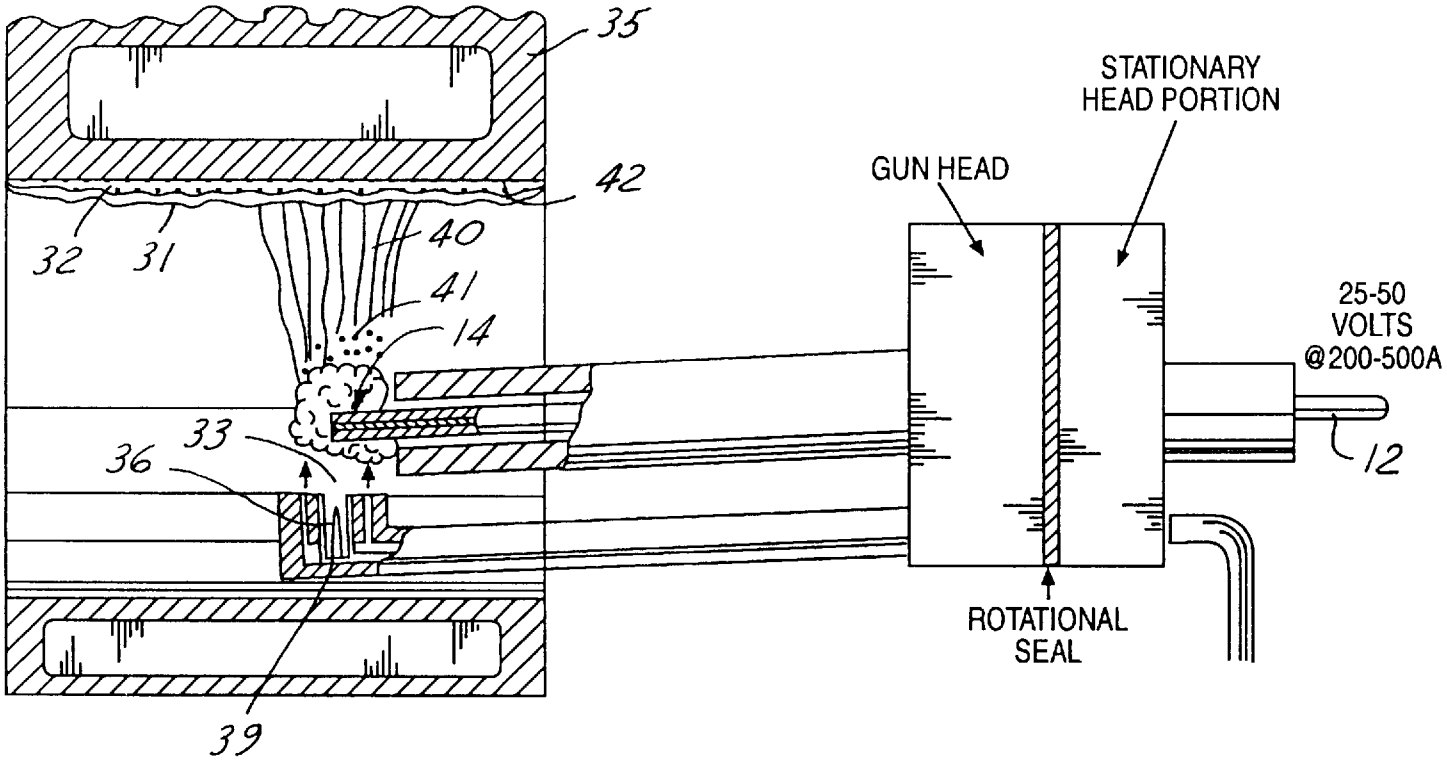
FIG. 2 is an illustration of a preferred overall apparatus system used to carry out the process.

To provide the type of coating 11 that is wear resistant and lubricious, a top coat 31 is thermally sprayed over the bonding metal 32 (see FIG. 2). The top coating 31 may be comprised of a low carbon alloy steel or preferably a composite Fe and FeO. If a composite top coating is desired, the wire feedstock 12 is comprised of a solid low carbon alloy steel and a secondary gas 34 is used that is controlled to permit oxygen to react with the droplets from the wire to oxidize and form the selective iron oxide $Fe_xO$ (Wuestite, a hard wear resistant oxide phase having a self lubricating property). The composite thus can act very much like cast iron that includes graphite as an inherent self lubricant. $Fe_xO$ is the lowest molecular form of iron oxide and is sometimes referred to as simply FeO; it excludes $Fe_2O_3$ and $Fe_3O_4$. The gas component for spraying, containing the oxygen can vary between 100% air (or oxygen) and 100% inert gas (such as argon or nitrogen) with corresponding degrees of oxygenation of Fe. The secondary gas flow rate should be in the range of 30–120 standard cubic feet per minute to ensure enveloping all of the droplets with the oxidizing element and to control the exposure of the steel droplets to such gas. Further description of how to obtain this composite coating is more fully described in pending U.S. application Ser. No. 08/666,071, which is commonly assigned to the assignee herein and the disclosure of which is incorporated herein by reference.

Thermal spraying of the bond coat 32 or the top coat 31 can be carried out by use of a thermal spraying gun or apparatus as illustrated in FIG. 2. The metallic wire feedstock 12 is fed into the plasma or flame 33 of the thermal gun such that the tip 14 of the feedstock melts and is atomized into droplets by high velocity primary gas jets 39. The gas jets project a spray 40 onto a light metal cylinder bore wall 42 of an engine block 35 and thereby deposit a coating. The gun may be comprised of an inner nozzle which focuses a heat source, such as a flame or plasma plume 33. The plasma plume is generated by stripping of electrons from the primary gas 39 as it passes between the central cathode 36 and inner nozzle 37 as a anode, resulting in a highly heated ionic discharge or plume. The plasma heat source melts the wire tip 14 and the resulting droplets 41 are projected at great velocity to the target. The pressurized secondary or shrouding gas 34 may be used to further control the spray pattern. Such secondary gas 34 is introduced through channels formed between the inner nozzle 37 and the nozzle housing. The secondary gas is directed radially inwardly with respect to the axis of the plume.

If the gun is to be constructed and operated as a transferred arc plasma torch, then the wire feedstock for the flux cored wire is feed toward the plasma plume 33, spaced from the nozzle a distant of about 4.5 millimeters from its face. The cathode electrode 36 is electrically energized with a negative charge and both the inner nozzle 37, as well as the wire 23, are positively charged as anodes. Initially when starting up the gun, a plasma gas is caused to flow through the nozzle assembly and after a short period of time, typically two seconds, a DC power supply is established to create an arc across the cathode electrode 36 and the inner nozzle 37 creating a pilot arc and plasma to be momentarily activated. Once this non-transferred plasma is established, extremely hot ionized electrically conducted gas flows out from the nozzle contacting with the tip of the wire to which a transferred arc can and is formed establishing a plasma current to flow from the cathode electrode 36 through the low pressure center region of the vortex flow through the opening in the inner nozzle, acting as a constricting orifice, to the tip of the wire. The wire then will be continuously fed into the transferred plasma stream sustaining the transferred arc even as the wire tip is melted off.

The resulting coating will be constituted with splat layers or particles. The heat content of the splat particles, as they contact the aluminum substrate, is high, i.e. about 1200°–2000° C. Preferably the bond coat is deposited in a thickness of about 50 micrometers and has a deposited particle size of about 2.5–8 micrometers.

Figure 3:
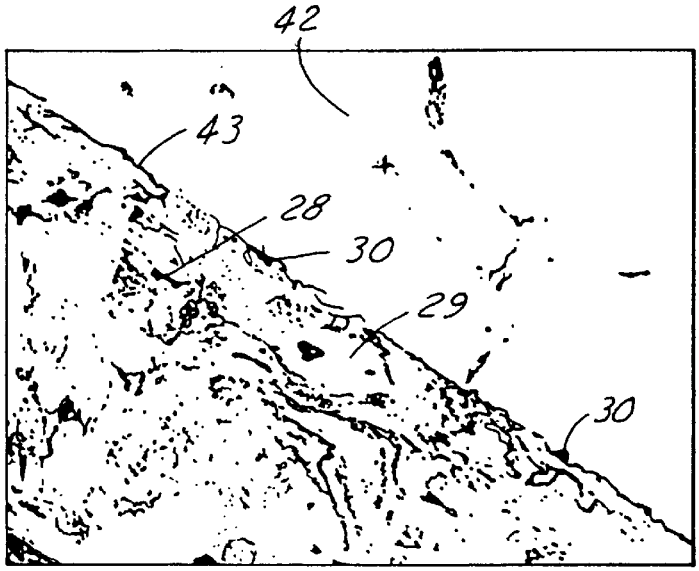
FIG. 3 is a illustration of the microstructural interface created between the deposited coating and aluminum substrate as a result of the use of this invention (200× magnification).
Figure 4:
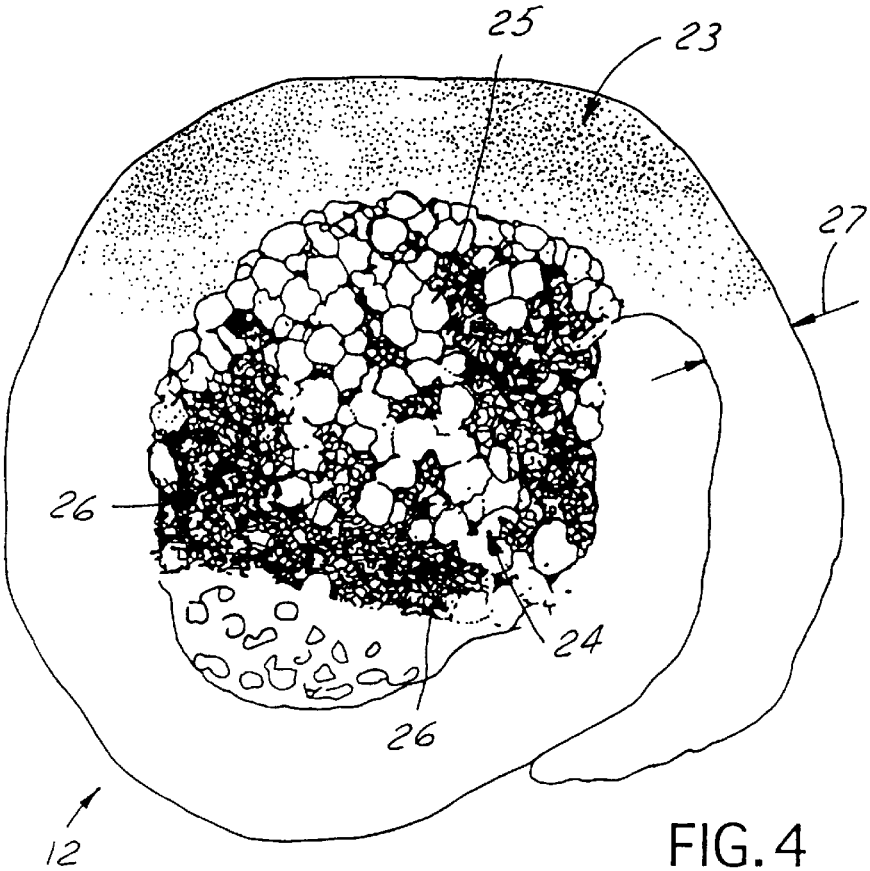
FIG. 4 is a greatly enlarged cross-section (85× magnification) of the powder cored wire feedstock used in this invention.

As shown in FIG. 3, the resulting product has an interface 43 between the thermal spray coating 32 and Al substrate (borewall 42) that is clear of any flux residue but provides particles of Ni (29) and NiAl (28) metallurgically bonded to the Al. The dynamics of thermal spray impacting has not increased or modified the porosity of the cast surface, but has maintained or increased adhesion strength (peel strength) by the substitution of some dispersed oxides 30 of Ni or Ni-Al. Optimum peel strength (in excess of 3000 psi) were obtained when the flux powder was limited to 0.7–3.0% by weight of the wire; this allowed the Ni-Al bonding powder to be slightly increased as a percentage of the weight of the wire to about 29–30. Increasing the amount of aluminum in the nickle-aluminide will serve to decrease the cost.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of thermally spraying at least one adherent metallic coating onto an unroughened cleansed aluminum or aluminum alloy substrate to produce a coated substrate, comprising:

wire arc thermally spraying of melted metallic bonding droplets and fluxing particles onto said substrate to concurrently and adherently deposit fluxing powder particles and bonding metal droplets, said spraying using air propulsion and a wire feedstock having a core and a sheath, the core being constituted of bonding metal powder readily metallurgically bondable to the substrate and a fluxing powder that readily deoxidizes the substrate, the wire sheath being constituted of pliable metal that is metallurgically compatible with said core metal powder, the flux powder having a halide chemistry effective to dioxidize said substrate when in contact with the melted droplets, said fluxing powder having a particle size of 2–40 micrometers and is smaller than the particle size of said bonding metal to more uniformly be distributed throughout said thermal spray, the resulting coating substrate exhibiting (i) an absence of flux residue and porosity at the interface between the bonding metal and substrate, and (ii) a distributed metallurgical surface between the substrate and deposited metal that consist of both deposited metal oxides as well as deposited metal and a total absence of substrate oxides.

2. The method as in claim 1, in which said sheath and bonding metal are each nickel based.

3. The method as in claim 1, in which said fluxing powder is comprised of KAlF salts.

4. The method as in claim 3, in which said KALF is predominately $KALF_4$ with minor amounts of $KAlF_5$ and $K_3AlF_6$.

5. The method as in claim 1, in which said fluxing powder constitutes 0.7–3% by weight of the wire.

6. The method as in claim 1, in which said bonding metal powder is selected from Ni-Al, Fe-Al, Al-bronze, and Si-bronze.

7. The method as in claim 1, in which the particle size of the bonding metal powder is 10–400 micrometers.

8. The method as in claim 1, in which the thickness of the sheath is about 0.01 inch.

9. The method as in claim 1, in which the melted bonding metal powder and the fluxing powder have a temperature of about 1500°–1800° C. and a velocity of about 100–200 meters per second when impacting the substrate.

10. The method as in claim 1, in which said wire arc thermal spraying is carried out with a spraying gun that rotates and traverses a cylinder bore of a engine block that acts as the substrate, the gun being supplied with a voltage effective to provide a deposition rate of at least 13 pounds per minute of the coating.

11. The method as in claim 10, in which the coated cylinder bore product has a peel strength of 3000 psi or greater.

* * * * *